US005612302A

United States Patent [19]

Yoshida et al.

[11] Patent Number: 5,612,302

[45] Date of Patent: Mar. 18, 1997

[54] CLEANING SOLUTION FOR RECYCLING RECORDING MEMBER HAVING TONER IMAGES

[75] Inventors: Masazumi Yoshida, Amagasaki; Susumu Tanaka, Aichi-Ken; Junji Machida, Toyonaka, all of Japan

[73] Assignee: Minolta Camera Kabushiki Kaisha, Osaka, Japan

[21] Appl. No.: 176,265

[22] Filed: Jan. 3, 1994

[30] Foreign Application Priority Data

| | | | |
|---|---|---|---|
| Jan. 8, 1993 | [JP] | Japan | 5-001659 |
| Dec. 17, 1993 | [JP] | Japan | 5-318071 |

[51] Int. Cl.[6] ..... C11D 1/08; C11D 1/83; C11D 3/20; C11D 3/60

[52] U.S. Cl. ..... 510/174; 510/421; 510/437; 510/488; 510/491

[58] Field of Search ..... 252/142, 143, 252/170, 171, 174.19, DIG. 14, 173, 108, 132, DIG. 8; 510/174, 421, 437, 488, 491

[56] References Cited

U.S. PATENT DOCUMENTS

| | | | |
|---|---|---|---|
| 3,816,318 | 6/1974 | Hentschel | 252/89 |
| 4,048,118 | 9/1977 | Suzaka et al. | 252/518 |
| 4,714,565 | 12/1987 | Wevers et al. | 252/174.19 |
| 4,863,628 | 9/1989 | Nambudiry | 252/132 |
| 5,476,739 | 12/1995 | Takama et al. | 430/42 |

FOREIGN PATENT DOCUMENTS

| | | |
|---|---|---|
| 50-156440 | 12/1975 | Japan . |
| 63-165591 | 7/1988 | Japan . |
| 4-65496 | 3/1992 | Japan . |
| 4-66685 | 3/1992 | Japan . |
| 4-89271 | 3/1992 | Japan . |
| 2001078 | 10/1993 | Russian Federation . |

OTHER PUBLICATIONS

Chemical Abstract accession No. 84:141494, Solov'eva et al., "Study of the electrical conductivity of monomethyl adipate–sodium monomethyl adipate–water–methanol . . . ", May 10, 1976.

Chemical Abstract accession No. 97:135662, Chen et al., "Study of the effect of adipic acid and its derivatives on the corrosion of steel in a sodium chloride solution. 1", Oct. 11, 1982.

Derwent abstracts accession No. 92–120581, for JP 04065496, Mar. 2, 1992.

Derwent abstracts accession No. 92–120971, for JP 04066685, Mar. 3, 1992.

*Primary Examiner*—Ardith Hertzog

*Attorney, Agent, or Firm*—McDermott, Will & Emery

[57] ABSTRACT

The present invention provides a cleaning solution for recycling a waste copy paper with toner-images formed on the surface of the copy paper, comprising water, a monoester of bivalent organic acid, a surface active agent and an organic acid.

11 Claims, No Drawings

CLEANING SOLUTION FOR RECYCLING RECORDING MEMBER HAVING TONER IMAGES

BACKGROUND OF THE INVENTION

1. Field of the Invention

The present invention relates to cleaning solution which can remove copy images formed with toner on copy paper by an electrophotographic machine or a printer.

2. Description of the Prior Art

A recycling technique has been paid attention to as a tender technique to the earth from the viewpoint of protection of resources. Recently, copying machines have been popular among companies, offices and other fields. A number of sheets of copy paper are used. Therefore a recycling technique of waste copy paper has been also studied for using the resources effectively.

In the conventional recycling technique, waste copy paper is cut into small pieces of paper for reproducing pulp and then toner which is developed on the waste copy paper is cleaned.

In the conventional recycling technique as above mentioned, however, the waste paper must be once collected and stored at some place. Further there also arise such problems that a pulp-reproducing machine and a toner-cleaning machine are complicated, huge and expensive. Accordingly the recycle of the waste paper has to rely on a specific dealer.

Moreover, in the conventional recycling technique, the length of fibers of the pulp is short even after the pulp is reproduced because the waste copy paper is cut into small pieces of paper. Therefore the reproduced paper is much liable to be torn.

A recycling technique which may solve the above problems is disclosed in Japanese Patent Laid-Open No. Hei 4-89271, in which waste paper is dipped in a cleaning solution such as water, alcohol, methyl ethyl ketone, toluene, ethyl acetate, caustic soda or surface active agent, and then the waste paper is subjected to a physical treatment.

However, the cleaning solution disclosed in the Japanese Patent cannot achieve the cleaning effects satisfactorily.

SUMMARY OF THE INVENTION

The object of the present invention is to provide a cleaning solution excellent in handling properties, which can reproduce copy-paper to give an excellent white degree without cutting the waste copy paper into small pieces.

The present invention relates to a cleaning solution for recycling waste copy paper with toner images formed on the surface of the copy paper, comprising at least a monoester of bivalent organic acid, an organic acid, a surface active agent and water.

DETAILED DESCRIPTION OF THE INVENTION

The present invention provides a cleaning solution for toner images comprising at least a monoester of bivalent organic acid, an organic acid, a surface active agent and water.

When copy paper having toner images on the surface thereof is dipped in the cleaning solution of the present invention, a toner resin does not dissolve but swells in the solution. At the same time, a distance between fibers in the paper is made longer. Therefore it becomes easier for toner to separate out from the fibers. At this time the toner is separated out from the surface of the paper easily when the surface of the paper is rubbed with a brush or a web a little. The separated toner aggregates or coagulates each other. The separated toner does not adhere to the paper again. The paper recycled according to the present invention is excellent in whiteness degree.

The cleaning solution of the present invention contains at least a monoester of bivalent organic acid, an organic acid, a surface active agent and water.

The organic acids useful in the present invention may be exemplified by saturated aliphatic acids, such as formic acid, acetic acid, propionic acid, butyric acid, valeric acid, pivalic acid, caproic acid, caprylic acid, capric acid, lauric acid, myristic acid, palmitic acid and stearic acid, unsaturated aliphatic acids, such as acrylic acid, propionic acid, methacrylic acid, crotonic acid, oleic acid, linoleic acid, erucic acid, ricinoleic acid, abietic acid and resin acid, aromatic carboxylic acids, such as benzoic acid, toluic acid, naphthoic acid, cinnamic acid, 2-furic acid, nicotinic acid and isonicotinic acid. The organic acid may be used singly and in combination with other organic acids. Among these organic acids, higher fatty acids, such as lauric acid, myristic acid, palmitic acid, stearic acid, oleic acid, linoleic acid, erucic acid, ricinoleic acid, abietic acid and resin acid are preferable in the present invention. Coconut oil, linseed oil, beef tallow and whale oil, which contain respectively the above higher fatty acids, may be used in the present invention.

The bivalent organic acid, which is one of the components of the monoester of bivalent organic acid, may be exemplified by saturated or unsaturated carboxylic acids, such as oxalic acid, malonic acid, succinic acid, glutaric acid, adipic acid, pimelic acid, suberic acid, azelaic acid, sebacic acid, maleic acid and fumaric acid, and aromatic carboxylic acids, such as phthalic acid, isophthalic acid and terephthalic acid. Among those acids, the saturated aliphatic acids, such as oxalic acid, malonic acid, succinic acid, glutaric acid, adipic acid, pimelic acid, suberic acid, azelaic acid and sebacic acid are preferable.

The alcohol, which is one of the components of the monoester of bivalent organic acid, may be exemplified by univalent alcohols (which may be straight or branched), such as methanol, ethanol, propanol, butanol and pentanol, polyvalent alcohols, such as ethylene glycol, glycerin, pentaerythritol and sorbitol, glycols, such as diethylene glycol, dipropylene glycol and polyethylene glycol, and Cellosolves, such as ethyl Cellosolve and butyl Cellosolve. The alcohol may be used singly or in combination with other alcohols.

The monoester of bivalent organic acid may be prepared by esterification reaction of the bivalent organic acid with the alcohol, or hydrolysis reaction of a diester of the bivalent organic acid.

Preferable monoesters of bivalent organic acid may be represented by the following formula:

$$HOOC—(CH_2)_n—COOR_1$$

in which $R_1$ represents an alkyl group having 1 to 5 carbon atoms and the letter "n" represents an integer of 0 to 8.

The monoester of bivalent organic acid represented by the above formula is particularly exemplified by:

monoester of oxalic acid ($HOOC—COOR_1$), monoester of malonic acid ($HOOC—CH_2—COOR_1$), monoester of succinic acid ($HOOC—(CH_2)_2—COOR_1$), monoester of glutaric acid ($HOOC—(CH_2)_3—COOR_1$), monoester of adipic acid ($HOOC—(CH_2)_4—COOR_1$),
monoester of pimelic acid ($HOOC—(CH_2)_5—COOR_1$),
monoester of suberic acid ($HOOC—(CH_2)_6—COOR_1$),
monoester of azelaic acid ($HOOC—(CH_2)_7—COOR_1$),
monoester of sebacic acid ($HOOC—(CH_2)_8—COOR_1$)
and a mixture thereof.

Among those monoesters, the one in which $R_1$ is methyl, ethyl or propyl is preferable from the viewpoint of water solubility. The monoester of bivalent organic acid may be used singly or in combination with other monoesters.

In order to remove toner-images from copy paper effectively, water is needed for swelling fibers in the copy paper to improve cleaning properties and a component which can swell and/or dissolve toner is needed. Therefore the component which can swell and dissolve toner is required to be compatible with water and excellent in swelling and dissolving powers. It is thought that the monoester of bivalent organic acid in the present invention is compatible with water and excellent in permeability to toner because of the presence of a carboxylic group and that the presence of an ester group secures the swelling and dissolving powers to toner.

The surface active agent useful in the present invention may be exemplified by an anionic surface active agent, a nonionic surface active agent, a cationic surface active agent, an amphoteric surface active agent and a mixture thereof. Conventionally, a surface active agent has been used as a cleaning agent for pulp of waste copy paper. However copy images can not be cleaned well from the waste copy paper even when the surface active agent itself is applied directly to the paper.

The anionic surface agent useful in the present invention may be exemplified by fatty acid esters, alkyl sulfuric esters, alkyl benzene sulfonates, alkyl naphthalene sulfonates, alkyl sulfosuccinates, alkyl diphenyl ether disulfonates, and formalin condensates of naphthalene sulfonates and polymeric surfactant of polycarboxylic acids.

The nonionic surface agent useful in the present invention may be exemplified by polyoxyethylene alkyl ethers, polyoxyethylene alkyl aryl ethers, copolymers of oxyethylene-oxypropylene, sorbitan fatty acid esters, polyoxyethylene-sorbitan fatty acid esters and polyoxyethylene alkyl amines.

The cationic surface agent and the amphoteric surface active agent are exemplified by alkyl amine salts, quaternary ammonium salts, alkyl betaines and amine oxides.

The above surface active agent may be used singly or in combination with each other. A particularly preferable surface active agent is a nonionic surface active agent of polyoxyethylene type represented by following formula:

$$RO(CH_2CH_2)_nH$$

in which R represents an alkyl group or an alkylphenyl group, the alkyl group having 21 to 22 carbon atoms; the letter n presents an integer of 1 to 10.

The cleaning solution for toner images in the present invention may be prepared by mixing at least the monoester of bivalent organic acid, the organic acid and the surface active agent at a specified ratio. The mixing method is not particularly limited.

The organic acid is contained in the cleaning solution at a desirable amount of 1 to 10 percent by weight to the total amount of the cleaning solution. The contribution of the organic acid to the cleaning properties is not clearly understood. It is, however, thought that the organic acid works to improve the permeability of the cleaning solution to toner or paper to clean toner effectively or in a short time.

The monoester of bivalent organic acid is contained in the cleaning solution of the present invention at an amount of 5 to 60 percent by weight, preferably 20 to 40 percent by weight to the total amount of the cleaning solution. If the content is more than 60 percent by weight, a solvency power of the solution to toner is too high, resulting in that the toner adheres again to paper. If the content is less than 5 percent by weight, swelling properties to toner are poor. Cleaning effect can not be given.

The surface active agent is contained in the cleaning solution of the present invention at an amount of 0.1 to 10 percent by weight, preferably 0.1 to 5 percent by weight to the total amount of the cleaning solution. If the content is more than 10 percent by weight, the cleaning agent generates bubbles so much that it becomes difficult to handle the solution. If the content is less than 0.1 percent by weight, toner once removed from paper adheres again to the paper.

Water is contained in the cleaning solution of the present invention at an amount of 1 to 80 percent by weight, preferably 30 to 80 percent by weight, more preferably 60 to 80 percent by weight to the total amount of the cleaning solution. If the content is more than 80 percent by weight, the structure of fibers in paper is broken. Moreover a lot of energy is needed for drying the paper. If the content is less than 1 percent by weight, a distance between fibers in the paper can not be made longer, and therefore the cleaning solution can not permeate through the paper sufficiently.

Further, the cleaning solution of the present invention may contain an organic solvent which can swell toner, such as methanol, ethanol, n-butanol and isopropanol, ethoxyethanol insofar as the effects of the invention are not ruined. Further xylene, toluene, acetone, THF, dioxane, dichloromethane may be mixed with the above solvent.

Once the cleaning solution of toner images is prepared, the monoester of bivalent organic acid may be hydrolyzed under the influences of water and the organic acids. The bivalent organic acid, diester of the bivalent organic acid and the alcohol may be also contained in the cleaning solution of the present invention because the di-esterification reaction or the hydrolysis of the monoester may be occurred.

The cleaning solution of the present invention may be applied to a sheet of copy paper, an OHP sheet made of polyester film and other conventional recording members on the respective surface of which toner images are formed of toner containing at least a resin. The copy images may be formed by means of so called OA apparatuses, such as conventional copying machines, printers and facsimile telegraphs.

In particular, the cleaning solution of the present invention is useful for waste copy paper on the surface of which copy images are formed of a toner containing styrene-acrylic copolymer resins, ester resins and other conventional resins for toner. There may be notes in the waste copy paper written with a ball pen, a marking pen, a pencil, fluorescent ink and vermilion ink etc.

Copy images formed of toner are removed by use of the cleaning solution of the present invention as follows. For example, waste copy paper is dipped in the cleaning solution and then the surface of the waste copy paper is rubbed with a web and a brush to give the surface physical forces.

The dipping conditions are adjusted depending on a toner, a cleaning solution, a copy paper. A dipping time of dozens of seconds to dozens of minutes gives excellent effects. When the cleaning solution is heated to 30° C. to 50° C., the effects of the present invention can be achieved in a shorter dipping time and cleaning efficiency can be further improved.

After the dipping, the surface of paper is rubbed a little. The toner separates out easily from the surface of the paper. The separated toner aggregates and coagulates each other to give rubber-like aggregates. The aggregates have strong adsorptivity to toner particles. As the adsorptivity is stronger than a bonding power between the toner and the paper-fibers, the aggregates seems to suck up the fixed toner from the surface of the paper one after another while contacting with the toner.

On the other hand, the surface active agent surrounds the separated toner to prevent the toner from adhering to the paper again. Water weakens the bonding power between fibers in paper. But as water is contained at an amount as small as it required, the paper neither scatter nor tear easily.

The toner-cleaning method is not limited to the one above mentioned in which a physical force is added to the waste copy paper dipped in the cleaning solution to remove toner on the surface of the paper. For example, the waste copy paper dipped in the cleaning solution is taken out from the solution and then the physical force is added to the surface of the paper to remove toner. In another method, the cleaning solution is applied or sprayed on the waste copy paper and then the copy images are transferred to a suitable release member. In this case, the release member may be heated and/or pressed when the copy images are transferred to the release member.

The monoester of bivalent organic acid, water and the organic acid in the cleaning solution of the present invention function to dissolve or swell ink or ink-particles of a ball pen, a marking pen and a fluorescent pen, a pencil and a vermilion ink. When the surface of the waste copy paper is rubbed with a web or a brush, the ink or ink-particles on the surface of the paper can be removed from the surface. The surface active agent prevents the ink or the ink-particles from being adsorbed into paper again.

The waste copy paper treated in the cleaning solution is dried sufficiently and used for printing again by a copying machine or a printer to give copy images as clear as the ones formed on new copy paper.

The cleaning solution of the present invention contains no fluorine compound and no chlorine compound, which is indicated to destroy a ozone layer. Therefore, the cleaning solution does not influence adversely on environments of the earth. Further, because the cleaning solution displays low toxicity to a human body and incombustibility (no flash point), it is very suitable to apply the cleaning solution to a reproduction machine used in offices.

EXAMPLE

Waste Copy Paper

Waste copy paper was prepared as follows.

(1) Toner (a) Toner A: one hundred parts by weight of polyester resin (softening point; 130° C., glass transition point;60° C., AV;25, OHV;38), 5 parts by weight of carbon black (MA#8; made by Mitsubishi Kasei K.K.) and 3 parts by weight of a dye (Bontron E-89; made by Orient Kagaku) were kneaded and pulverized to give Toner A having a mean particle size of 13 μm.

(b) Toner B: one hundred parts by weight of styrene-acrylic copolymer resin (softening point;132° C., glass transition point;60° C.), 5 parts by weight of carbon black (MA#8; made by Mitsubishi Kasei K.K.) and 3 parts by weight of Nigrosine dye (Bontron N-01; made by Orient Kagaku) were kneaded and pulverized to give Toner B having a mean particle size of 10 μm.

(c) Toner C: one hundred parts by weight of styrene-acrylic copolymer resin (softening point;132° C., glass transition point;60° C.), 10 parts by weight of carbon black (REGAL330R; made by Cabot Corporation) and 3 parts by weight of quaternary ammonium salt 912; made by Arakawa Kagaku Kogyo K.K.) were kneaded and pulverized to give Toner C having a mean particle size of 10 μm.

(2) Copying Machine

Copying machines EP5425 and EP8600 (made by Minolta Camera K.K.) were used. Toner A was put in EP8600. Toner B and Toner C were respectively put in EP5425.

(3) Copy Paper

Copy paper of A4 size having 64 g/m$^2$ was used.

(4) Fixing Process

Toner was fixed at about 170° C.

Some notes were written with a black ball pen, a red ball pen, a fluorescent pen (pink etc.) a marking pen, a pencil or vermilion ink on the copy paper after copied.

Example 1

Water soluble Tosclean D (made by Nagamune Sangyo K.K.) was used as a cleaning solution. Tosclean D contains:

about 26 wt % of a mixture of methyl monoester of succinic acid, methyl monoester of glutaric acid and methyl monoester of adipic acid as the monoester of bivalent organic acid, about 3 wt % of a surface active agent of polyoxyethylene type, about 8 wt % of a mixture of oleic acid, palmitic acid and linoleic acid as the organic acid, and about 60 wt % of water Tosclean D is an aqueous detergent of a pale yellow transparent liquid and has a acid value of about 2.1 mgKOH/g, a specific gravity of 1.020 (20° C.), pH of 7 ±0.5 (15° C.).

Example 2

A cleaning solution containing:

about 20 wt % of methyl monoester of succinic acid as the monoester of bivalent organic acid, about 1 wt % of a surface active agent of polyoxyethylene type, about 1 wt % of oleic acid as the organic acid, and about 78 wt % of water was used.

Example 3

A cleaning solution containing:

about 30 wt % of methyl monoester of glutaric acid as the monoester of bivalent organic acid, about 1 wt % of a surface active agent of polyoxyethylene type, about 1 wt % of linoleic acid as the organic acid, and about 68 wt % of water was used.

Example 4

A cleaning solution containing:

about 40 wt % of methyl monoester of adipic acid as the monoester of bivalent organic acid, about 1 wt % of a surface active agent of polyoxyethylene type, about 1 wt % of oleic acid as the organic acid, and about 58 wt % of water was used.

Cleaning Process

The waste copy paper was dipped in the cleaning solution in a pan for 60 seconds at a normal temperature. Then the waste copy paper was rubbed slightly with a web to remove copy images from the surface of the paper.

Evaluation

Cleaning properties are evaluated according to the cleaning efficiency represented by the following formula:

$$\text{Cleaning Efficiency (\%)} = \frac{(I.D) - (I.D \text{ after cleaned})}{(I.D.)}$$

in which I.D represents image density.

The results of the cleaning efficiency of the cleaning solution are summarized in Table 1 below.

TABLE 1

| | Toner A | Toner B | Toner C |
|---|---|---|---|
| Example 1 | 97% | 98% | 98% |
| Example 2 | 96% | 97% | 98% |
| Example 3 | 96% | 97% | 97% |
| Example 4 | 96% | 97% | 97% |

The notes written with the black ball pen, the red ball pen, the fluorescent pen, the marking pen, the pencil or vermilion ink on the copy paper could be removed about 100%.

In another method, a solution was blown strongly in a jet stream on the paper instead of the web to give similar effects. When the cleaning solution was heated to 30°–50° C., the cleaning time could be shortened. Ultrasonic wave was further added to give much better effects.

Comparative Example 1

Xylene was used as a cleaning solution.

Comparative Example 2

A cleaning solution was prepared in a manner similar to Example 2 except that water was not contained.

Comparative Example 3

A cleaning solution was prepared in a manner similar to Example 2 except that methyl monoester of succinic acid was not contained.

Comparative Example 4

A cleaning solution was prepared in a manner similar to Example 2 except that oleic acid was not contained.

Evaluation

The waste copy paper having toner images formed with Toner B was dipped in the cleaning solution in a pan for 60 seconds at a normal temperature. Then the waste copy paper was rubbed slightly with a web to remove copy images from the surface of the paper.

The cleaning efficiency was 13.4% (Comparative Example 1), 50% (Comparative Example 2), 2% (Comparative Example 3) and 70% (Comparative Example 4).

What is claimed is:

1. A cleaning solution for removing a resin formed toner image from a recording member, comprising a monoester of bivalent organic acid, an organic acid, 0.1 to 5 percent by weight of a surface active agent and water.

2. The cleaning solution of claim 1, wherein the monoester of bivalent organic acid is represented by the following chemical formula:

$$HOOC—(CH_2)_n—COOR_m$$

wherein $R_1$ represents an alkyl group having 1 to 5 carbon atoms and the letter n represents an integer of 0 to 8.

3. The cleaning solution of claim 1, in which the water is contained at an amount of 1 to 80 percent by weight.

4. The cleaning solution of claim 1, in which the monoester of bivalent organic acid is contained at amount of 5 to 60 percent by weight.

5. The cleaning solution of claim 1, in which the organic acid is contained at amount of 1 to 10 percent by weight.

6. The cleaning solution of claim 1, in which the surface active agent is selected from the group consisting of an anionic surface active agent, a nonionic surface active agent, a cationic surface active agent, an amphoteric surface active agent and a mixture thereof.

7. The cleaning solution of claim 1, in which the organic acid is selected from the group consisting of lauric acid, myristic acid, palmitic acid, stearic acid, oleic acid, linoleic acid, erucic acid, ricinoleic acid, abietic acid, resin acid and a mixture thereof.

8. A cleaning solution for removing a resin-formed toner image from a recording member, comprising a monoester of bivalent organic acid, an organic acid, 0.1 to 5 percent by weight of a surface active agent and water, wherein said monoester of bivalent organic acid is represented by the following chemical formula:

$$HOOC—(CH_2)_n—COOR_1$$

in which $R_1$ represents an alkyl group having 1 to 5 carbon atoms and the letter n represents an integer of 0 to 8.

9. The cleaning solution of claim 8, in which the monoester of bivalent organic acid is selected from the group consisting of monoester of oxalic acid, monoester of malonic acid, monoester of succinic acid, monoester of glutaric acid, monoester of adipic acid, monoester of pimelic acid, monoester of suberic acid, monoester of azelaic acid, monoester of sebacic acid and a mixture thereof.

10. The cleaning solution of claim 5, wherein the monoester of bivalent organic acid is present in an amount of 5 to 60 percent by weight.

11. A cleaning solution for removing a resin-formed toner image from a recording member which has the resin-formed toner image on the surface thereof, comprising:

(a) from 5 to 60 percent by weight of a monoester of a bivalent organic acid represented by the following chemical formula:

$$HOOC—(CH_2)_n—COOR_1$$

wherein $R_1$ represents an alkyl group having 1 to 5 carbon atoms and the letter n represents an integer of 0 to 8;

(b) from 0.1 to 5 percent by weight of a surface active agent;

(c) from 1 to 80 percent by weight of water; and (d) from 1 to 10 percent by weight of organic acid.

* * * * *